US006701837B2

(12) United States Patent
Ohba et al.

(10) Patent No.: US 6,701,837 B2
(45) Date of Patent: Mar. 9, 2004

(54) WIDTHWISE PAPER DRIFT CORRECTION DEVICE FOR ELONGATED WEB-LIKE PRINT PAPER

(75) Inventors: Tetsuya Ohba, Hitachinaka (JP); Shigeru Obata, Tsuchiura (JP); Yasushi Kinoshita, Tsuchiura (JP)

(73) Assignee: Hitachi Printing Solutions, Ltd., Kanagawa-Ken (JP)

( * ) Notice: Subject to any disclaimer, the term of this patent is extended or adjusted under 35 U.S.C. 154(b) by 0 days.

(21) Appl. No.: 10/324,091

(22) Filed: Dec. 20, 2002

(65) Prior Publication Data

US 2003/0116042 A1 Jun. 26, 2003

(30) Foreign Application Priority Data

Dec. 20, 2001 (JP) ..... P2001-387171

(51) Int. Cl.[7] ..... B41F 13/56

(52) U.S. Cl. ..... 101/225; 101/227; 101/228; 101/231; 400/579; 400/630; 400/631; 400/632; 400/633; 400/632.1

(58) Field of Search ..... 101/225, 227, 101/228, 231; 400/579, 630, 631, 632, 633, 632.1

(56) References Cited

U.S. PATENT DOCUMENTS 3,204,109 A * 8/1965 Goodwin ..... 250/239
3,724,733 A * 4/1973 Schaffer et al. ..... 226/25
4,049,213 A * 9/1977 Hank et al. ..... 242/563.1
4,077,579 A * 3/1978 Seleski et al. ..... 242/563.1
4,146,797 A * 3/1979 Nakagawa ..... 250/548
4,291,825 A * 9/1981 Glanz ..... 226/18
4,728,800 A * 3/1988 Surka ..... 250/559.42
5,213,036 A * 5/1993 Tokuno et al. ..... 101/232
5,501,148 A * 3/1996 Bellio et al. ..... 101/232
5,553,542 A * 9/1996 Jackson et al. ..... 101/228
5,564,846 A * 10/1996 Katsumata ..... 400/611
5,647,276 A * 7/1997 Tilton, Sr. ..... 101/219
6,357,349 B1 * 3/2002 Tomberlin et al. ..... 101/219
6,373,042 B1 * 4/2002 Kretschmann et al. ... 250/208.1
6,408,757 B2 * 6/2002 Ogawa et al. ..... 101/480

* cited by examiner

*Primary Examiner*—Andrew H. Hirshfeld
*Assistant Examiner*—Andrea H. Evans
(74) *Attorney, Agent, or Firm*—McGuireWoods LLP

(57) ABSTRACT

To stably transport an elongated web-like print paper so as not to move in the widthwise direction of the print paper, a first sensor is disposed at a first position in a paper conveying path and a second sensor at a second position downstream of the first position with respect to the paper conveying direction. Both the first and second sensors detect a position of a side edge or the print paper. A difference between the outputs from the first and second sensors is computed while taking a travel time of the edge detected by the first sensor to reach the second sensor into account. A main controller generates a drive signal based on the difference computed and controls a mechanism for moving the print paper in the widthwise direction in accordance with the drive signal.

19 Claims, 5 Drawing Sheets

WIDTHWISE PAPER DRIFT CORRECTION DEVICE FOR ELONGATED WEB-LIKE PRINT PAPER

BACKGROUND OF THE INVENTION

1. Field of the Invention

The present invention relates to a printing device for printing on an elongated web-like print paper. More particularly, the invention relates to a paper drift correction device for correcting the position of a print paper drifted in the widthwise direction during travel of the print paper within the printing device.

2. Description of the Related Art

In a printing device of the type in which an elongated web-like print paper travels along a predetermined meandering path to reach a printing position, the print paper is liable to drift or shift in the widthwise direction. To correct the widthwise drift of the print paper, conventional printing devices employ a correction device having a sensor that detects the side edge of the print paper. With the correction device, the print paper is moved back to the right position when the output from the sensor indicates that the side edge of the print paper is drifted from a reference position.

However, the cut condition in the side edges of the print paper differs in different manufacturers and in different slots of paper produced even by the same manufacturer and also differs depending upon a side edge cutting machine used. For the print papers with side edges that are not cut to the same condition, the sensor outputs a signal to correct the widthwise position of the print paper. Moving the print paper in accordance with the output of the sensor may result in incorrect positioning of the print paper.

SUMMARY OF THE INVENTION

In view of the foregoing, it is an object of the invention to provide a printing device that is capable of stably transporting an elongated web-like print paper while not allowing the print paper to drift in the widthwise direction.

To achieve the above and other objects, there is provided an improved printing device for printing on an elongated web-like print paper. The print paper has a width and side edges substantially perpendicular to a widthwise direction of the print paper. A printing device includes a paper conveying mechanism for conveying the print paper along a predetermined path, the print paper being conveyed so that side edges are in coincidence with a paper conveying direction; a first sensor disposed at a first position in the predetermined path, for sensing a position of a side edge of the print paper and outputting a first signal; a second sensor disposed at a second position in the predetermined path, the second position being apart a predetermined distance from the first position and downstream of the first position with respect to the paper conveying direction, the second sensor sensing a position of the side edge of the print paper and outputting a second signal; delaying means for delaying outputting the first signal by a predetermined period of time corresponding to a paper conveying time for conveying the print paper from the first position to the second position; computing means for computing a difference between the first signal output from the delaying means and the second signal and outputting a difference signal; a widthwise moving mechanism for moving the print paper in the widthwise direction; and a controller for generating a drive signal based on the difference signal and outputting the drive signal to the widthwise moving mechanism so that the widthwise moving mechanism is driven in response to the drive signal and corrects the position of the print paper in the widthwise direction.

Averaging means may further be provided for computing an average of difference signals output from the computing means over a predetermined period of time. In this case, the controller generates the drive signal based on the averaged difference signal.

A low-pass filter may be connected to the output of the computing means for removing a high frequency component contained in the drive signal. In this case, the controller generates the drive signal based on the filtered drive signal.

BRIEF DESCRIPTION OF THE DRAWINGS

The particular features and advantages of the invention as well as other objects will become apparent from the following description taken in connection with the accompanying drawings, in which:

FIG. 2(*b*) is a cross-sectional view showing the paper guide and a print paper passing therethrough;

FIG. 3(*b*) is a top view showing the base and swing rollers;

FIG. 4(*b*) is a top view showing the sensor and the print paper to be sensed by the sensor;

DETAILED DESCRIPTION OF THE EMBODIMENTS

A printing device according to the embodiment of the invention will be described with reference to the accompanying drawings.

Figure 1:
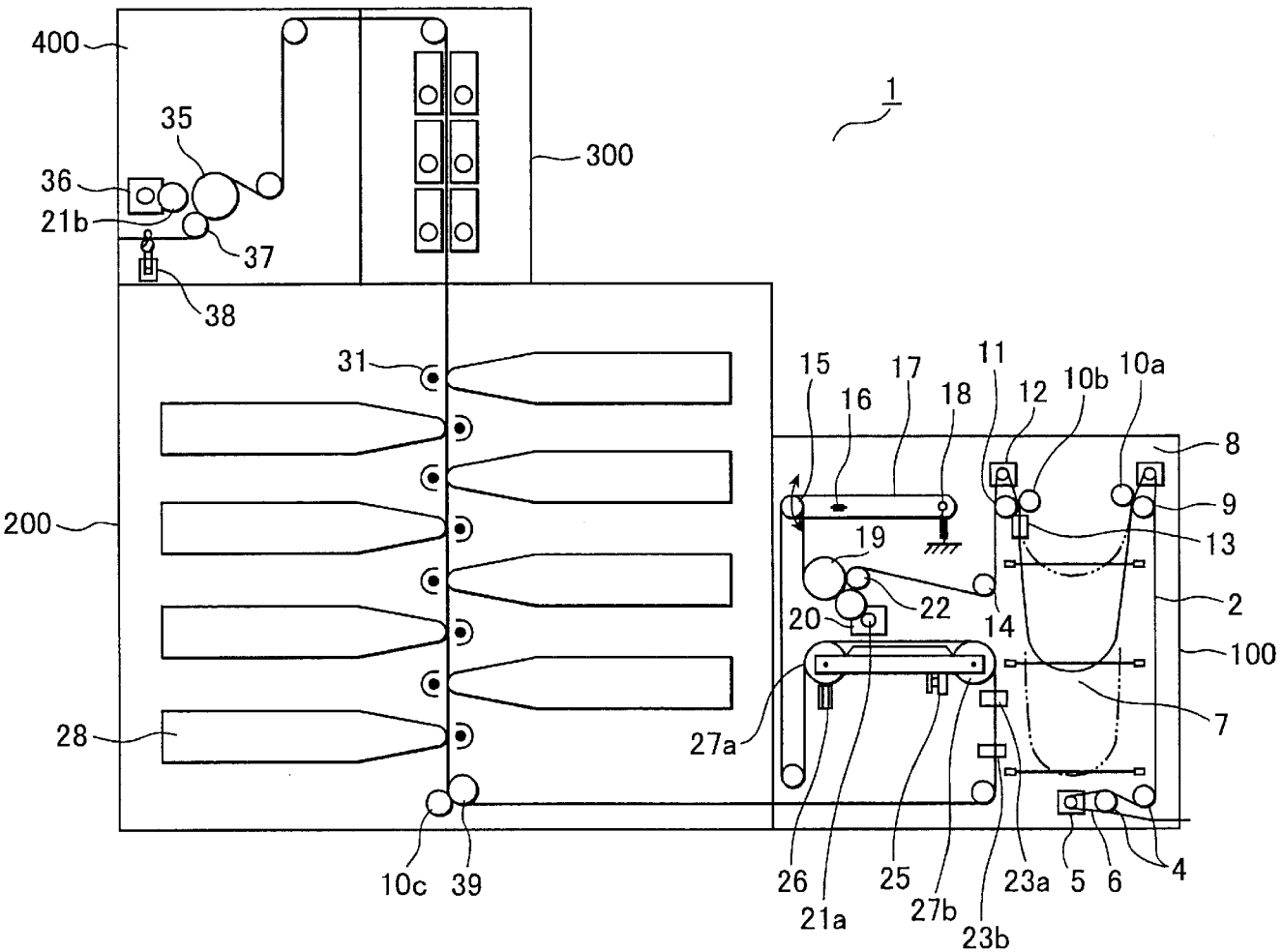
FIG. 1 is a schematic diagram illustrating a printing device according to one embodiment of the invention.

As shown in FIG. 1, the printing device 1 includes a sheet feed section (not shown), an in-feed section 100, a printing section 200, a fixing section 300, and an out-feed section 400. The sheet feed section feeds an elongated web-like print paper 2 into the in-feed section 100. The in-feed section 100 is made up of three sections including a buffer lead-in section, a tension imparting section and a paper drift correction section.

The buffer lead-in section includes an upstream lead-in portion disposed in a position adjacent to a print paper entrance port from which the print paper 2 is introduced, and a downstream lead-in portion. The upstream lead-in portion includes a sliding roller 4, a booster motor 5, and a timing belt 6. The sliding roller 4 is rotatably coupled via the timing belt 6 to the booster motor 5 and rotates at a peripheral speed higher than a paper traveling speed. The downstream lead-in portion includes a motor 8, a buffer roller 9 driven by the motor 8, and a driven roller 10*a* urged against the buffer roller 9.

An air buffer 7 is provided downstream of the buffer lead-in section for slackening the print paper 2. The print paper 2 between a tension roller 11 and the buffer roller 9 is slackened. The tension roller 11 is driven by a torque motor 12 that stably generates a predetermined level of torque and can control the level of the torque as desired. A load roller 10*b* is movable toward and away from the tension roller 11. When the load roller 10*b* is moved toward the tension roller 11 and urged thereagainst, the load roller 10*b* is driven by the tension roller 11, thereby conveying the print paper 2 nipped between the rollers 10*b* and 11.

Figure 2A:
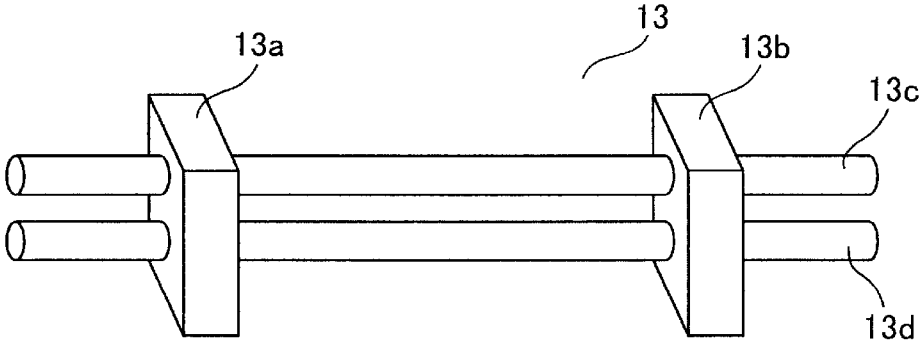
FIG. 2(*a*) is a perspective view showing a paper guide.
Figure 2B:
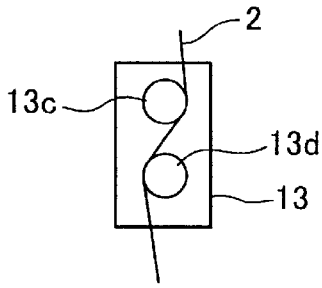

A paper guide 13 is disposed upstream of the tension roller 11 to prevent the slackened print paper 2 from being moved in the widthwise direction. As shown in FIG. 2(*a*), the paper guide 13 is configured by a pair of guide blocks 13*a* and 13*b* and a pair of rods 13*c* and 13*d* extending in parallel to each other and passing through the guide blocks 13*a* and 13*b*. The guide block 13*a* is fixed to the two rods 13*c* and 13*d* whereas the guide block 13*b* is movably supported by the two rods 13*c* and 13*d* so as to be movable toward and away from the guide block 13*a*. The position of the guide block 13*b* is adjusted depending upon the size of the print paper 2. As shown in FIG. 2(*b*), the print paper 2 passes through a space between the two rods while contacting the peripheral surfaces of the two rods 13*c*, 13*d*. The print paper 2 that has passed through the paper guide 13 is shifted 1 mm or so in the widthwise direction.

The tension of the print paper 2 is primarily determined by the torque generated by the tension roller 11 and the winding angle of the print paper 2 wound around the periphery of a fixed roller 14 disposed downstream of the tension roller 11. With the paper guide 13 and the fixed roller 14, the distance of the print paper 2 drifted in the widthwise direction of the print paper 2 can be restricted to some extent.

A dancing arm 17 is disposed near the corner diagonally opposite the corner where the paper entrance port is formed. One end of the dancing arm 17 is fixedly secured to a housing with a spring 18 and another end of the arm 17 rotatably supports a dancing roller 15. The dancing roller 15 rotates following the transportation of the print paper 2. The arm 17 is pivotally movable about the pin 16 fixed to the arm 17 at a position between the two ends but closer to the end supporting the dancing roller 15. By the pivotal movement of the arm 17, the dancing roller 15 moves toward and away from an in-feed roller 19.

A position sensor (not shown) is disposed near the dancing arm 17 to sense the position of the dancing arm 17. The rotations of the in-feed roller 19 are controlled in accordance with the output from the position sensor. A feed-in motor 20 drives the in-feed roller 19 via a gear 21*a*. A nip roller 22 is urged against the in-feed roller 19 to nip the print paper 2 therebetween.

The tension imparting section is configured by the tension roller 11, fixed roller 14, dancer roller 15, pin 16, dancer arm 17, spring 18, in-feed roller 19, feed-in motor 20, gear 21*a*, and nip roller 22.

Figure 3A:
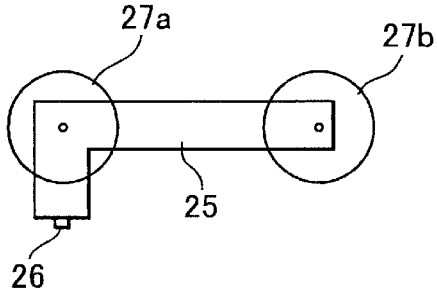
FIG. 3(*a*) is a side view showing a base and swing rollers.
Figure 3B:
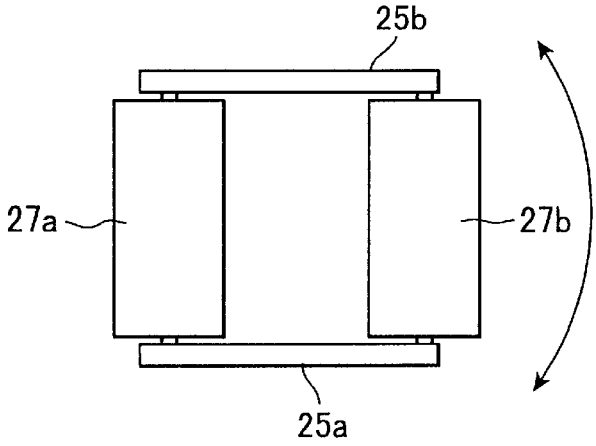

A base 25 is disposed downstream of the arm 17. As shown in FIG. 3(*a*), the base 25 has an L-shaped cross-section and is configured by a pair of opposing side frames. A pair of swing rollers 27*a*, 27*b* is rotatably supported by a pair of shafts that is bridged between the side frames 25*a*, 25*b*. A pin 26 is downwardly protruded from the base 25 and is positioned just beneath the swing roller 27*a* and between the side frames 25*a*, 25*b*. The base 25 is swingably movable about the pin 26, so that the swing rollers 27*a*, 27*b* conveying the print paper 2 can move the print paper 2 in the widthwise direction, i.e., a direction perpendicular to the paper traveling direction, depending upon the swung position of the base 25.

Figure 4A:
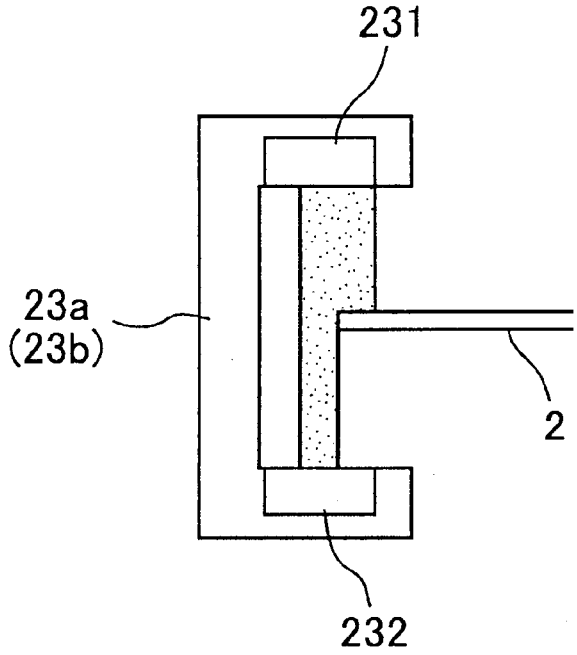
FIG. 4(*a*) is a cross-sectional side view showing a sensor and the print paper to be sensed by the sensor.
Figure 4B:
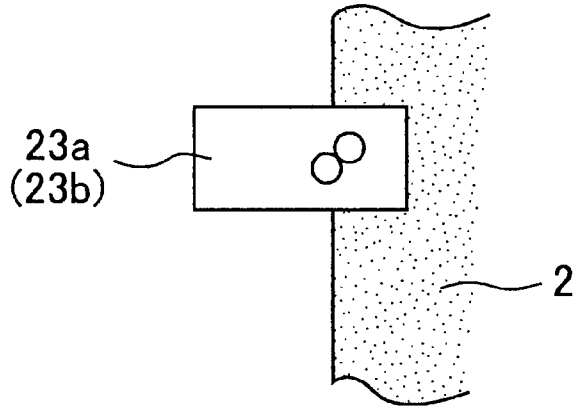

A pair of sensors 23*a*, 23*b* is disposed downstream of the swing rollers 27*a*, 27*b*. Each sensor includes a light emitting section 231, such as an LED (light emitting diode), and a light receiving section 232, such as a photodiode. The side edge portion of the print paper 2 is positioned between the light emitting section 231 and the light receiving section 232. As shown in FIGS. 4(*a*) and 4(*b*), the sensor 23*a* (23*b*) detects the paper side edge. Specifically, the position of the paper side edge can be determined based upon an amount of light received at the light receiving section 232, which amount will reduce when the print paper 2 shifts outwardly in the widthwise direction whereas increase when the print paper 2 shifts inwardly in the widthwise direction. As will be described later, the position control motor corrects the widthwise position of the print paper 2 based on the outputs from the sensors 23*a*, 23*b* by swingingly moving the base 25. The sensors 23*a*, 23*b*, the position control motor, and swing rollers 27*a*, 27*b* configure the paper drift correction section.

The print section 28 is disposed downstream of the in-feed section 3 and includes a light source, such as LEDs or a source of laser, a photosensitive member, a developing unit, a transfer unit 31 for transferring toner images formed on the photosensitive member onto the print paper 2. The print paper 2 carrying the toner images thereon is fed into the fixing section 300 for thermally fixing the toner images on the print paper 2.

The fixing section 300 includes a hear source and a plurality of heat plates for supplying thermal energy to the print paper 2. The fixing section 300 heats the print paper 2 so as to melt toner and adhere the melted toner to the print paper 2. When the temperature of the print paper 2 is cooled down, the toner image is fixed to the print paper 2. The print paper 2 with the toner image fixed thereon is discharged by an out-feed section 400 out to the printer 1. The out-feed section 400 includes an out-feed roller 35, an out-feed motor 36 for driving the out-feed roller 35, a gear 21*b* for transmitting the driving power of the motor 36 to the roller 35, a nip roller 37 urged against the out-feed roller 35 and nipping the print paper 2 therebetween, and a puller 38. The tension of the print paper 2 located between the in-feed roller 19 and the out-feed roller 35 is determined by the dancing roller 15. Generally, the tension imparted upon a sheet of paper is set to a range between 30 to 200N and is adjusted depending upon the length and width of the paper.

Figure 5:
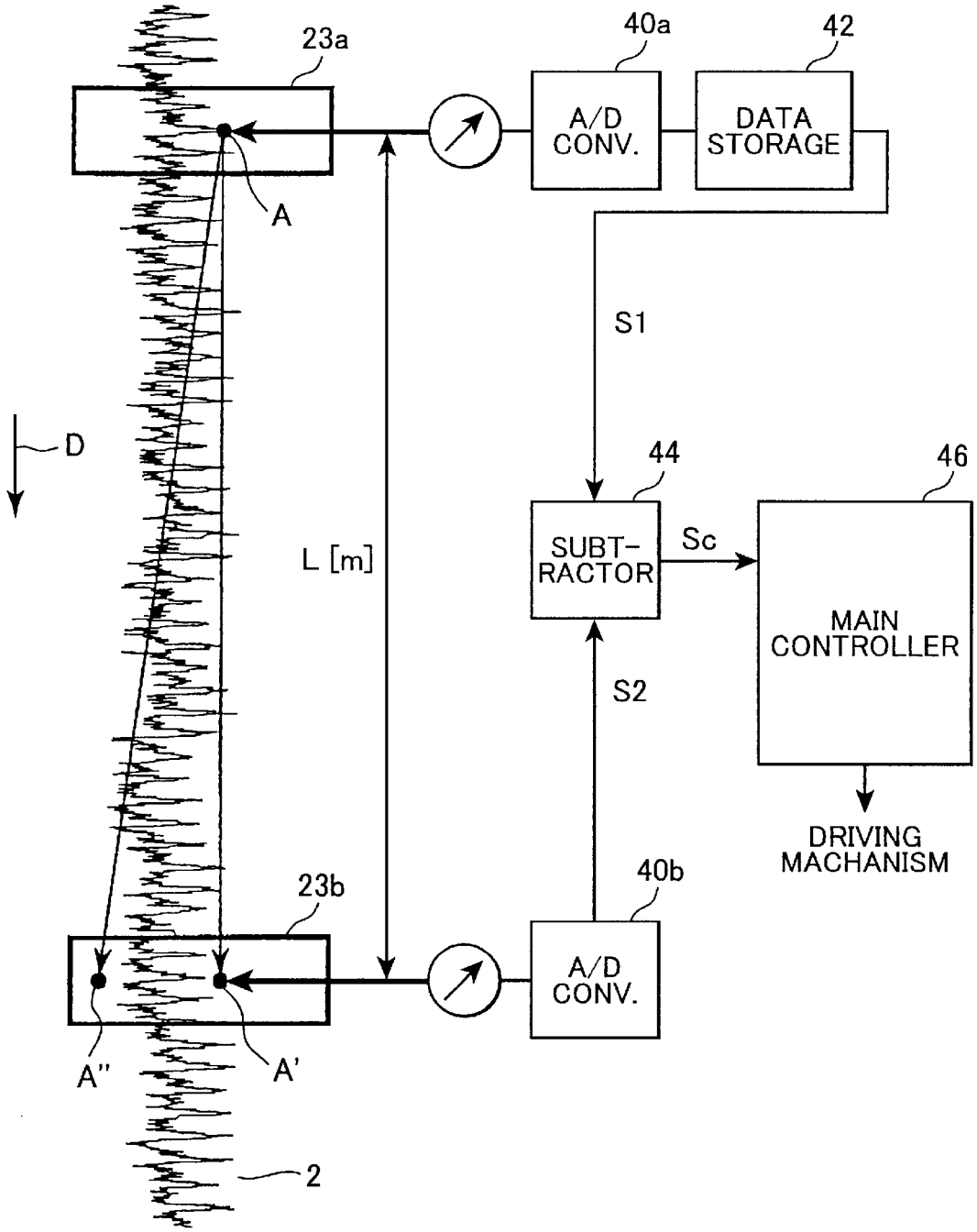
FIG. 5 is a sensor output processing system illustrated in a block form.
Figure 6:
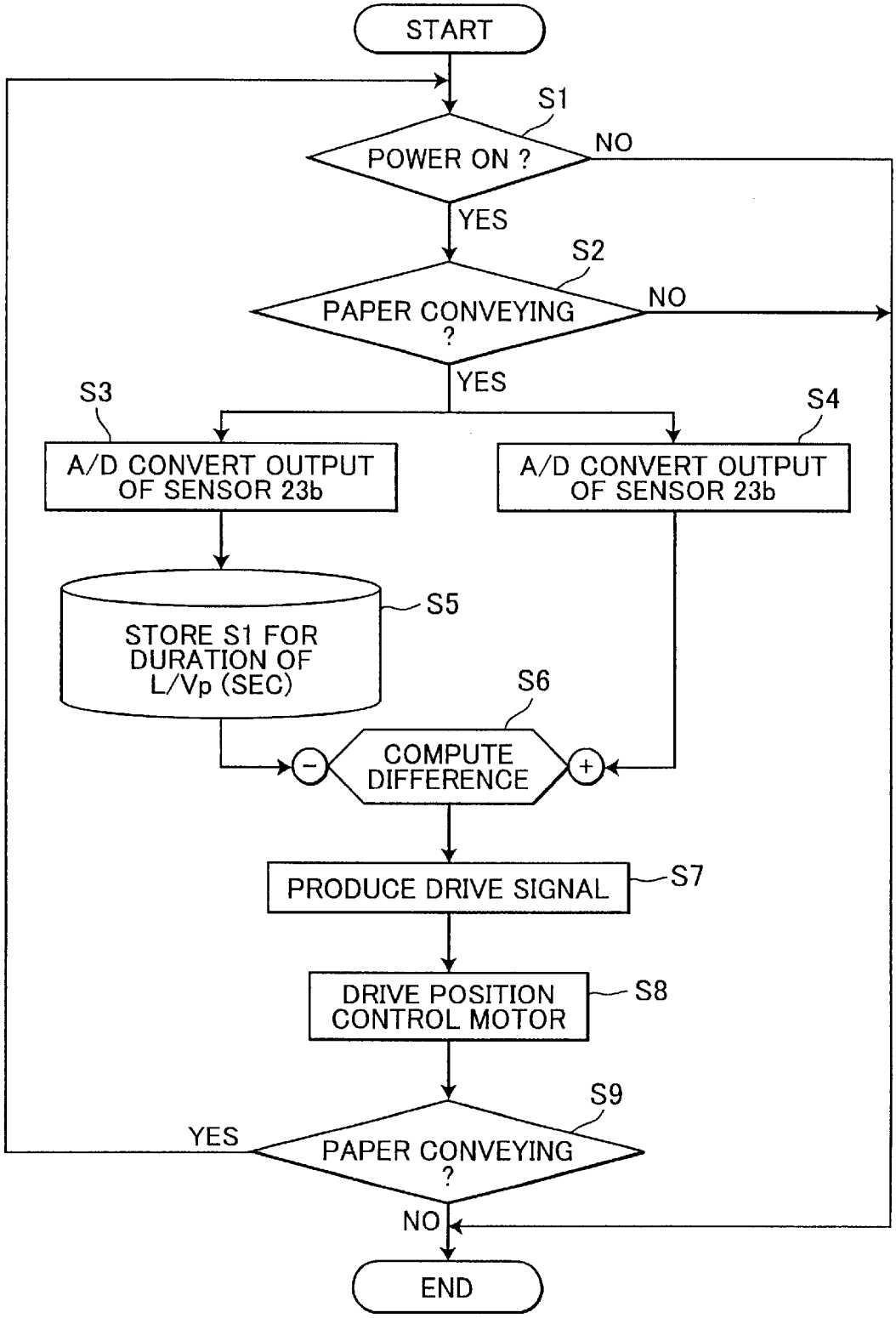
FIG. 6 is a flowchart illustrating operation of the system shown in FIG. 5.

FIG. 5 shows two sensors 23*a*, 23*b* and their associated processing system. FIG. 6 is a flowchart illustrating the operation of the processing system shown in FIG. 5.

As shown in FIG. 5, two sensors 23*a*, 23*b* are disposed in spaced-apart relation along the paper traveling path to detect the edge of the print paper 2. A voltage signal is output from the sensor 23*a* and is subjected to analog-to-digital conversion by an A/D converter 40*a*. The output of the A/D converter 40*a* is temporarily stored in a data storage 42 and is supplied to a subtracter 44. Likewise, a voltage signal is output from the sensor 23*b* and is subjected to analog-to-digital conversion by an A/D converter 40*b*. However, the output of the A/D converter 40*b* is directly supplied to the subtracter 44.

The subtracter 44 computes a difference of the two input signals S1 and S2 supplied from the data storage 42 and the A/D converter 40*b* and outputs a difference signal Sc to a main controller 46. The main controller 46 produced a drive signal based on the difference signal Sc, a drive gain and other factors. The drive signal is supplied to a driving mechanism (not shown) for moving the base 25.

A distance between the two sensors 23*a* and 23*b* will be represented by L(m), and a print paper traveling speed by Vp(m/sec). The date storage 42 is provided for delaying the output of the A/D converter 40*a* by a duration of time L/Vp (sec). The portion of the paper side edge detected by the sensor 23*a* is moved to the position of the sensor 23*b* during a time L/Vp. Accordingly, the two sensors 23*a*, 23*b* detect the same portion of the print paper 2 and so the output from the subtracter 44 is not influenced by the change in paper edge condition.

If the print paper 2 does not move in the widthwise direction during transportation from the position of sensor 23*a* to the position of sensor 23*b*, then paper side edge at position A in the sensor 23*a* is also detected by the sensor 23*b*. The corresponding position at the sensor 23*b* is indicated by A'. In this case, the signals S1 and S2 are at the same level so that the difference signal Sc from the subtracter 44 is 0 (zero). However, if the paper slide edge is moved in the widthwise direction perpendicular to the paper conveying direction D, the paper side edge at position A in the sensor 23*a* will be detected at the sensor 23*b* to be positioned at A". Therefore, the difference signal Sc output from the subtracter 44 is not zero and indicates the widthwise movement of the print paper 2.

Referring to the flowchart of FIG. 6, when the operation of widthwise paper drift correction device is started, it is first checked in step (hereinafter abbreviated to "S") 1 whether the printing device 1 is powered. If the printing device 1 has not yet been powered ("No" in S1), then the operation of the correction device is ended. If the printing device 1 has been powered ("Yes" in S1), then it is checked in S2 whether the print paper 2 is being conveyed. If the conveyance of the print paper 2 has not yet been started ("No" in S2), then the operation of the correction device is ended. If the print paper 2 is being conveyed ("Yes" in S2), then the outputs of the sensors 23*a*, 23*b* are converted to digital signals by the A/D converter 40*a*, 40*b* (S3 and S4). In S5, the digital signal corresponding to the output of the sensor 23*a* is stored in the data storage 42 for a period of time L/Vp (sec) and then retrieved therefrom and supplied to the subtracter 44. The digital signal corresponding to the output of the sensor 23*b* is directly supplied to the subtracter 44 with no time delay.

In S6, the subtracter 44 computes a difference between the two signals one supplied from the data storage 42 and the other from the A/D converter 40*b*, and outputs the difference signal Sc. In S7, the main controller 46 converts the difference signal Sc to a drive signal while taking output gain and other factors into account. In S8, the drive signal is applied to the position control motor to thereby move the base 25 and to thus correct the paper position in the widthwise direction. In S9, it is checked if the print paper 2 is being conveyed. If affirmative ("Yes" in S9), then the routine returns to S1 and repeats the processes described above. If the print paper 2 is not being conveyed ("No" in S9), then the control process will end.

With the above-described structure and control process, the widthwise paper drift can be accurately detected regardless of the paper side edge condition and the position error of the print paper can be corrected.

While the invention has been described in detail with reference to specific embodiments thereof, it would be apparent to those skilled in the art that various changes and modifications may be made therein without departing from the spirit of the invention, the scope of which is defined by the attached claims.

For example, although the above-described embodiment employs only a pair of sensors, plural pairs of sensors may be provided. Further, a reflection type sensor is also usable instead of a transmissive type sensor as described in the embodiment. The above-described embodiment describes that the printing section 200 performs an electrophotographic printing, however, an ink jet printing section may be used in place of the electrophotographic printing section. In this case, the fixing section 300 needs to be replaced by a drying section for drying the ink on the print paper 2.

It should be noted that an error contained in the difference signal Sc caused by the fluctuation of paper travel speed or measurement error of the sheet feed travel speed can be obviated by the following measure. Because the higher frequency components contained in the difference signal Sc indicates an error caused by the measurement error of averaged sheet feed travel speed, the error can be removed by passing the difference signal Sc through a low-pass filter. To this end, it is required that the low-pass filter be connected to the output or the subtracter 44. The main controller 46 generates the drive signal based on the output of the low-pass filter.

In the case where the paper travel speed Vp fluctuates, the error caused thereby appears as the lowest frequency component in the difference signal Sc. Therefore, to eliminate the influence of the paper travel speed fluctuation, it is necessary to compute an average of the lowest frequency components over a predetermined period of time. To this end, the main controller 46 has to perform averaging operation for computing an average of difference signals output from the subtracter 44 over a predetermined period of time. In this case, the main controller 46 generates the drive signal based on the average difference signal.

What is claimed is:

1. A printing device for printing on an elongated web-like print paper having a width and side edges substantially perpendicular to a widthwise direction of the print paper, the printing device comprising:

a paper conveying mechanism for conveying the print paper along a predetermined path, the print paper being conveyed so that side edges are in coincidence with a paper conveying direction;

a first sensor disposed at a first position in the predetermined path, for sensing a position of a side edge of the print paper and outputting a first signal;

a second sensor disposed at a second position in the predetermined path, the second position being apart a predetermined distance from the first position and downstream of the first position with respect to the paper conveying direction, the second sensor sensing a same portion of the print paper as the first sensor at a position of the side edge of the print paper and outputting a second signal;

delaying means for delaying outputting the first signal by a predetermined period of time corresponding to a paper conveying time for conveying the print paper from the first position to the second position;

computing means for computing a difference between the first signal output from the delaying means and the second signal and outputting a difference signal;

a widthwise moving mechanism for moving the print paper in the widthwise direction; and a controller for generating a drive signal based on the difference signal and outputting the drive signal to the widthwise moving mechanism so that the widthwise moving mechanism is driven in response to the drive signal and corrects the position of the print paper in the widthwise direction.

2. The printing device according to claim 1, wherein the delaying means comprises a data storage for storing the first signal, the first signal stored in the data storage being retrieved after expiration of the predetermined period of time.

3. The printing device according to claim 1, wherein the first sensor comprises a first light emitting section and a first light receiving section, and the second sensor comprises a second light emitting section and a second light receiving section.

4. The printing device according to claim 1, further comprising averaging means for computing an average of difference signals output from the computing means over a predetermined period of time and outputting an avenged difference signal, the controller generating the drive signal based on the averaged difference signal.

5. The printing device according to claim 1, further comprising a low-pass filter connected to the output of the computing means, for removing a high frequency component contained in the drive signal and outputting a filtered drive signal, the controller generating the drive signal based on the filtered drive signal.

6. The printing device according to claim 1, further comprising an in-feed section and a printing sections the in-feed section feeding the print paper into the printing section, wherein the first sensor and the second sensor are disposed in the in-feed section.

7. The printing device according to claim 1, wherein a distance between the first sensor and the second sensor in the paper conveying direction is represented by L, and a print paper traveling speed is represented by Vp such that the predetermined period of time for delaying outputting the first signal is a duration of time L/Vp.

8. The print device according to claim 7, wherein a portion of the paper side edge detected by the first sensor is moved to the position of the second sensor during the time L/Vp such that the first sensor and the second sensor detect the same portion of the print paper and the output from the computing means is not influenced by change in a paper edge condition.

9. The print device according to claim 1, wherein when the print paper moves in the widthwise direction perpendicular to the paper conveying direction, the difference signal computed by the computing means is not zero.

10. The print device according to claim 1, wherein when the print paper does not move in the widthwise direction perpendicular to the paper conveying direction, the difference signal computed by the computing means is zero.

11. The printing device according to claim 1, wherein the first sensor and the second sensor are one of a reflection type sensor and a transmissive type sensor.

12. The printing device according to claim 5, wherein higher frequency components contained in the difference signal indicate an error caused by a measurement error of an averaged sheet feed travel speed.

13. The printing device according to claim 5, wherein when a paper travel speed Vp fluctuates, an error caused thereby appears as a lowest frequency component in the difference signal.

14. The printing device according to claim 13, further including an averaging means for eliminating an influence of the paper travel speed fluctuation.

15. The printing device according to claim 14, wherein the controller performs an averaging operation for computing an average of difference signals output from the computing means over a predetermined period of time to generate the drive signal based on the averaged difference signal.

16. A printing device, comprising:

a paper conveying mechanism;

a first sensor for sensing a position of a side edge of a print paper and outputting a first signal;

a second sensor disposed at a second position downstream of the first sensor with respect to a paper conveying direction, the second sensor sensing a same portion of the print paper as the first sensor at a position of the side edge of the print paper and outputting a second signal;

delaying means for delaying outputting the first signal by a predetermined period of time corresponding to a paper conveying time for conveying the print paper from the first position to the second position;

computing means for computing a difference between the first signal and the second signal and outputting a difference signal;

a widthwise moving mechanism for moving the print paper in a widthwise direction perpendicular to a paper conveying direction; and a controller for generating a drive signal based on the difference signal and outputting the drive signal to the widthwise moving mechanism so that the widthwise moving mechanism is driven in response to the drive signal and corrects the position of the print paper in the widthwise direction.

17. A method for correcting misalignment of a print paper in a widthwise direction, the method comprising:

outputting a first voltage signal corresponding to a detected edge of a paper at a first location;

outputting a second voltage signal corresponding to a detected edge of the paper downstream from the first location in a paper feeding direction, the detected edge corresponding to the first and second voltage signal being at a same portion of the paper;

temporarily storing the first voltage signal;

delaying outputting the first voltage signal by a predetermined period of time corresponding to a paper conveying time for generating the second voltage signal;

computing a difference between the first voltage signal and the second voltage signal, where there is no time delay associated with the second voltage signal;

outputting a difference signal based on the computing step;

generating a drive signal based on the difference signal; and outputting the drive signal to a widthwise moving mechanism such that the widthwise moving mechanism, driven in response to the drive signal, corrects a position of the print paper in the widthwise direction.

18. The method according to claim 17, wherein the detected edge corresponding to the first and the second voltage signal are a same detected edge.

19. The method according to claim 17, wherein;

when the detected edge corresponding to the first and second voltage signal are the same, the difference signal is 0; and when the detected edge corresponding to the first and second voltage signal are not the same, the difference signal is not 0.

* * * * *

UNITED STATES PATENT AND TRADEMARK OFFICE

CERTIFICATE OF CORRECTION

PATENT NO. : 6,701,837 B2
DATED : March 9, 2004
INVENTOR(S) : Tetsuya Ohba et al.

It is certified that error appears in the above-identified patent and that said Letters Patent is hereby corrected as shown below:

Title page,
Item [57], ABSTRACT,
Line 7, change “side edge or the print paper” to -- side edge of the print paper --.

Column 7,
Line 12, change “avenged” to -- averaged --.
Line 22, change “sections” to -- section, --.

Signed and Sealed this

Fifteenth Day of June, 2004

JON W. DUDAS
*Acting Director of the United States Patent and Trademark Office*